US006253403B1

(12) United States Patent
Veschi

(10) Patent No.: US 6,253,403 B1
(45) Date of Patent: Jul. 3, 2001

(54) TOOL INCORPORATING WRITING MECHANISM

(76) Inventor: John P. Veschi, 8468 Oak Knoll St., Fogelsville, PA (US) 18051

( * ) Notice: Subject to any disclaimer, the term of this patent is extended or adjusted under 35 U.S.C. 154(b) by 0 days.

(21) Appl. No.: 09/220,643

(22) Filed: Dec. 24, 1998

Related U.S. Application Data

(60) Provisional application No. 60/070,209, filed on Dec. 31, 1997.

(51) Int. Cl.[7] ..... B25B 15/00
(52) U.S. Cl. ..... 7/165; 81/460
(58) Field of Search ..... 7/165, 170, 160; 401/52, 195; 81/436, 460

(56) References Cited

U.S. PATENT DOCUMENTS 1,069,312 * 8/1913 Zwiebel ..... 81/436
1,423,127 * 7/1922 Levy ..... 7/165 X
2,329,398 * 9/1943 Duffy ..... 81/436 X
2,896,576 * 7/1959 Baer ..... 7/160 X
3,405,748 * 10/1968 Sorteberg ..... 81/436
3,409,058 * 11/1968 LaPointe ..... 81/460 X
4,237,754 * 12/1980 Battrick ..... 81/436 X
4,602,397 * 7/1986 Chao ..... 7/160 X
5,114,257 * 5/1992 Hsu ..... 7/160 X
5,233,715 * 8/1993 Huang ..... 7/160 X
5,511,262 * 4/1996 Horng ..... 7/160
5,557,818 * 9/1996 Leon ..... 7/160
5,638,566 * 6/1997 Wu ..... 7/165 X
5,916,278 * 6/1999 Garcia ..... 7/165

* cited by examiner

*Primary Examiner*—D. S. Meislin

(57) ABSTRACT

A tool according to the invention includes elements adapted to achieve a primary function of the tool, and further includes a writing element adapted to achieve a writing function. In one example, the tool is a screwdriver, and the writing element comprises a pencil lead that can be extended from the head end of the screwdriver to achieve a writing function, and retracted within the head end of the screwdriver to perform a screwdriving function.

17 Claims, 2 Drawing Sheets

TOOL INCORPORATING WRITING MECHANISM

This application claims priority to U.S. Provisional Patent Application No. 60/070,209, filed Dec. 31, 1997.

FIELD OF THE INVENTION

This invention is directed to the field of tools, such as screwdrivers.

BACKGROUND OF THE INVENTION

Carpenters, at-home handy-men and women, and others frequently use a plurality of tools to accomplish a task, such as driving a screw, as part of the accomplishment of an overall project. An example of a common project is the project of hanging a picture or mirror on a wall. Frequently, the weight of the picture or mirror to be hung on the wall mandates that the picture or mirror be hung from a screw or nail driven into a stud behind finished drywall. A stud detector is a known device that enables a user to determine the location of studs behind the finished drywall.

It is frequently inconvenient, when a person is attempting to accomplish such a task, for the person to realize that in assembling the required tools to accomplish the task the person neglected to provide a marking instrument, such as a pencil, for use in marking the location of the stud. This inconvenience is heightened if the person is on top of a ladder or in some other out-of-the-way position, from which there is no easy access to a workbench, desk or other location at which a pencil could be found. The person accomplishing the task must thus climb down the ladder and locate a pencil, then climb back up the ladder to continue the task.

The aforementioned project is but one example of a project where a marking instrument is necessary in conjunction with conventional tools. In addition to the requirement to assemble the proper tools and instruments, it is also frequently necessary and inconvenient for a person, when in a precarious position, such as at or near the top of a ladder, to maneuver a plurality of instruments, including, for example, some or all of the following: a screwdriver and screws, a hammer and nails, a level, a stud detector, a tape measure, a paint brush and paint, or any other set of tools and materials associated with a project, while simultaneously maneuvering a pencil or other writing instrument in order to mark a stud point, to mark a level point, to record a measurement of length, or for any other purpose for which a pencil is conventionally employed during a home project. It is not uncommon for a pencil to be precariously positioned on a ladder step or shelf while the person performs a task with another tool, and for the pencil to then roll off the step or shelf while the task is being performed, requiring the person to interrupt the task in order to retrieve the pencil.

SUMMARY OF THE INVENTION

The invention solves this problem by incorporating a writing instrumentality into a tool, such as a screwdriver. Accordingly, a tool according to the invention includes elements adapted to achieve a primary function of the tool, and further includes a writing element adapted to achieve a writing function. In one example, the tool is a screwdriver, and the writing element comprises a pencil lead that can be extended from the head end of the screwdriver to achieve a writing function, and retracted within the head end of the screwdriver to perform a screwdriving function.

DETAILED DESCRIPTION

Figure 6:
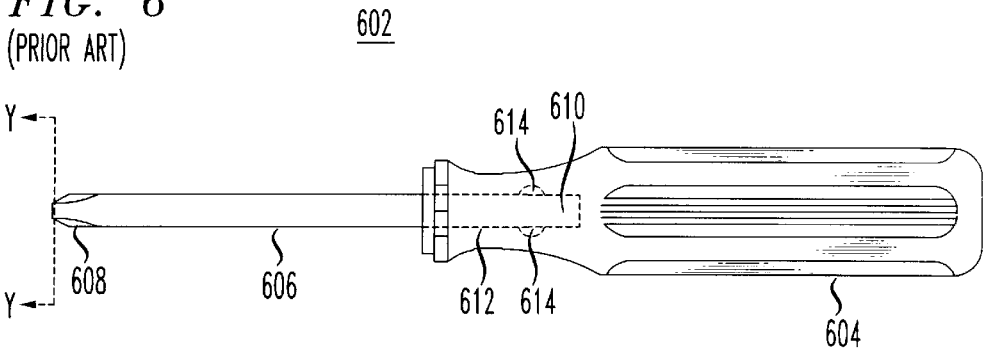
FIG. 6 (PRIOR ART)
FIG. 6 is a rough sketch of a conventional screwdriver.

FIG. 6 is a rough sketch of a conventional screwdriver 602 including a handle 604, a shaft 606, and a head 608. Conventionally, handle 604 is made from a plastic or rubber material, while shaft 606 and head 608 are integrally formed from a metal material, such as steel. Typically, an end 610 of shaft 606 opposite head 608 is affixed inside an orifice 612 of handle 604 to couple shaft 606 (and hence head 608) to handle 604. To facilitate this coupling, shaft 606 may include one or more wings 614 to tap into handle 604 or to mate with grooves formed therein.

Figure 7:
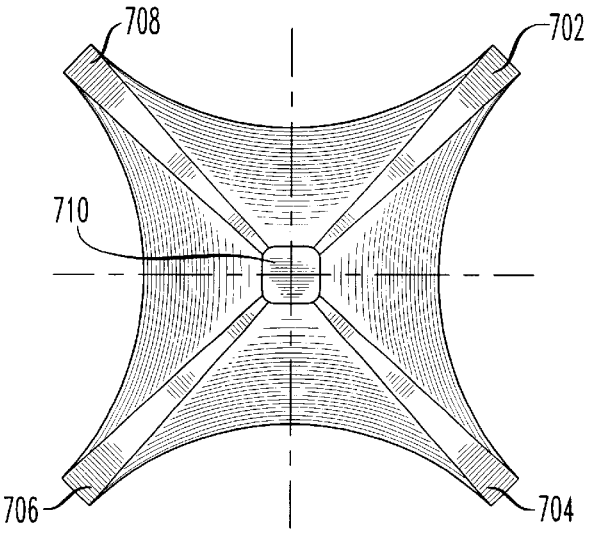
FIG. 7 is a rough sketch of a cross-section of the screwdriver of FIG. 6.

FIG. 7 is a rough sketch of a cross-section of head 608 taken along the Y—Y plane (FIG. 6) of a conventional #2 Phillips-head screwdriver. Flanges 702, 704, 706 and 708 radiate from a central region 710. Flanges 702–708 are positioned to mate with corresponding grooves in a conventional #2 Philips screw.

Figure 1:
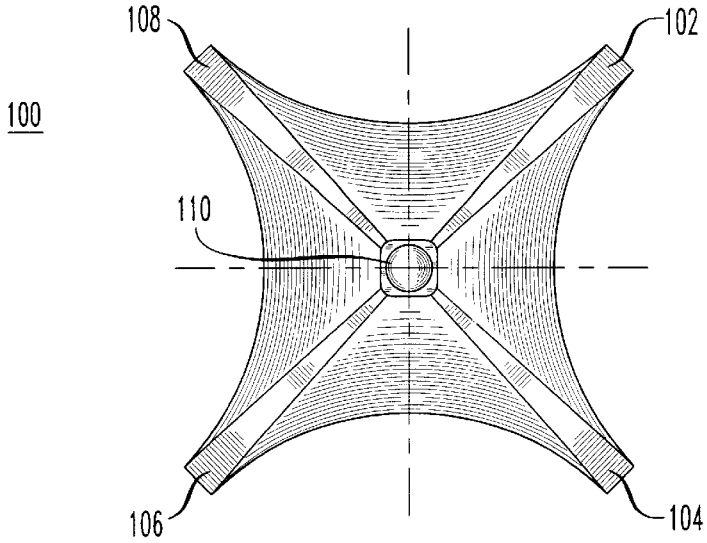
FIG. 1 is a rough sketch of a cross-section of an exemplary tool configured according to the invention.

FIG. 1 is a rough sketch of a corresponding cross-section for a screwdriver head 100 according to the invention. Here, flanges 102, 104, 106 and 108 perform like functions to flanges 702–708 of FIG. 7. In contrast to the screwdriver shown in FIG. 7, however, a portion of central region 710 is replaced with an opening 110 sized to accommodate a writing element, such as a pencil lead, such as a 0.5 mm pencil lead.

Figure 2:
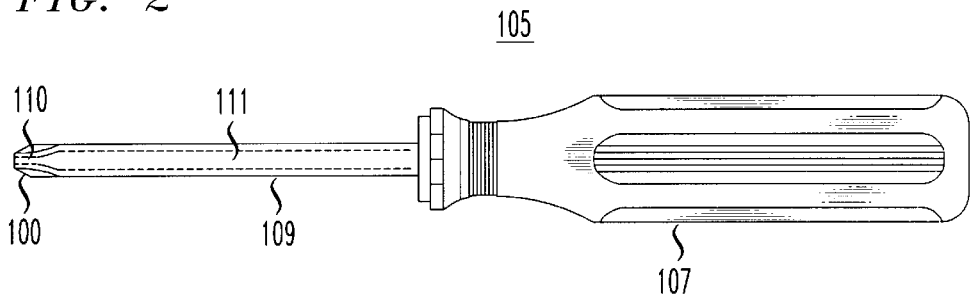
FIG. 2 is a rough sketch of a screwdriver configured to incorporate a writing element according to the invention.

FIG. 2 is a rough sketch of a screwdriver 105 according to the invention, including head 100 having opening 110, a handle 107, and a shaft 109. Opening 110 is in communication with a chamber 111 internal to shaft 109. According to the invention, a lead holding element is positioned in chamber 111. In one embodiment according to the invention, chamber 111 is aligned with a similar chamber through handle 107, such that the lead holding element may be positioned within both handle 107 and shaft 109. The design and structure of lead holding elements are known. Preferably, the chamber 111 is sized to accommodate a conventional lead holding element as used in conventional mechanical pencils, such as the 0.5 mm Pentel P205.

Figure 3:
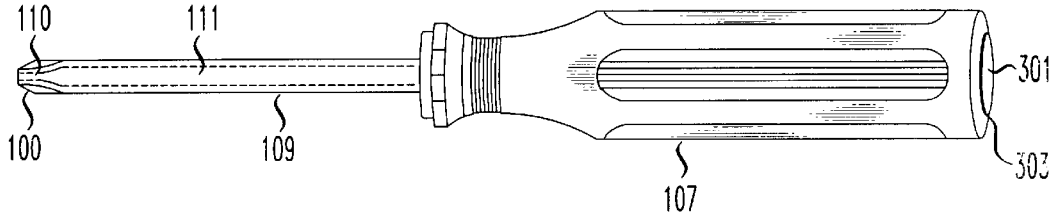
FIG. 3 is a rough sketch showing an exemplary lead extending element according to the invention.

FIG. 3 is a rough sketch of an exemplary embodiment, wherein handle 107 includes a cap 301 positioned in a corresponding hole 303. For example, cap 301 may be threaded into hole 303. Alternatively, cap 301 may be snap fit or frictionally fit into hole 303 or may be snap or frictionally fit onto a lead holding element, a portion of which is stored within handle 107. In any event, cap 301 provides an avenue for access to the inside of opening 303 in order to add lead to the lead holding element, for example.

Cap 301 may also be coupled to the lead holding element such that cap 301 can be manipulated by a user to correspondingly suppress a spring portion of the lead holding element and to cause a portion of a lead to be displaced in a longitudinal direction toward or out of opening 110. The coupling of a cap to a lead holding element is known to one of skill in the an of mechanical pencils. In the illustrative embodiment, cap 301 is coupled to the lead holding element accordingly. Continued suppression of cap 301 will thus cause a lead to be extended from (i.e. to be clicked out of) opening 110.

When finished writing, and/or when screwdriver 105 is needed to drive a screw, cap 301 can be suppressed in concert with inward pressure on the extended lead, to thereby cause the lead to be retracted into the lead holding element. This procedure can be managed, for example, by suppressing cap 301 while simultaneously placing head 100 into a screw to be driven. As pressure is placed on the screw by head 100, corresponding pressure will push the lead back into the lead holding element.

Figure 4:
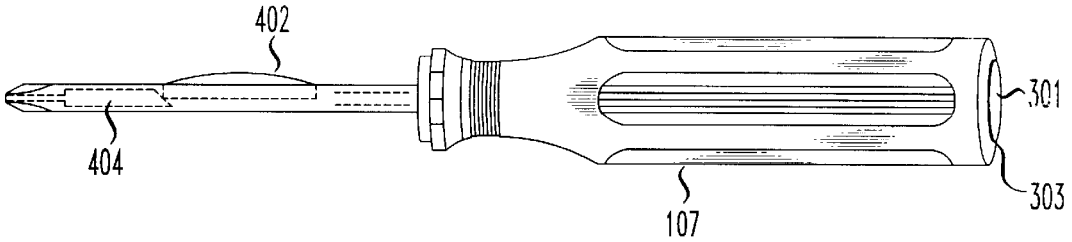
FIG. 4 is a rough sketch showing an alternative lead extending element according to the invention.

The use of cap 301 as both an entry vehicle into the inside of handle 107, and also as a lead extending element manipulable by the user is purely by way of example, and not of limitation. It is of course possible for the lead extending element to be separate from the cap 301. For example, as shown in FIG. 4, the lead extending element can include a button 402 positioned along the side of shaft 109 and coupled to a translating element 404 through which suppression of button 402 is translated into longitudinal motion of a lead held by the lead holding element. An example of such a translating element can be seen in the Sanford Clickster mechanical pencil.

The lead holding elements described above advance the lead by clicking the lead out through opening 10. Alternatively, the lead holding element can be screw driven, whereby the lead is advanced and retracted by a screwing action. in a manner which is also employed in conventional mechanical pencils. For example, cap 301 can be press fit onto the lead holding element, and can be manipulable by the user such that when the user twists the cap 301 in one direction, such as the clockwise direction, the lead extends through and out of opening 110, and when the user twists cap 301 in the other direction, such as the counterclockwise direction, the lead retracts through opening 110 and back into the lead holding element.

Cap 301 may also be used in the manufacture of tool 105 to enable insertion of the lead holding element. The lead holding element can be press fit into chamber 111, by a conventional technique as known to one of skill in the art or may be configured to screw into a portion of chamber 111, either by mating with corresponding threads or by self tapping.

Shaft 109 and head 100 may be integrally formed from steel, or may alternatively be formed from titanium or a hard composite. Chamber 111 may be formed in shaft 109 as part of the step of manufacturing shaft 109. Alternatively, shaft 109 may be formed in a conventional manner, and subsequently drilled and/or tapped to produce chamber 111 and opening 110. The material selected for shaft 109 and head 100 should be sufficiently strong so that head 100 can accommodate torque forces encountered when driving a screw, given the "loss" in material associated with opening 110 when compared to central region 710. The strength and composition of the lead passing through opening 110, as well as its size with respect to opening 110, may also be selected to increase the overall strength of head 100 when the lead is present in, but not extending from, opening 110.

Figure 5:
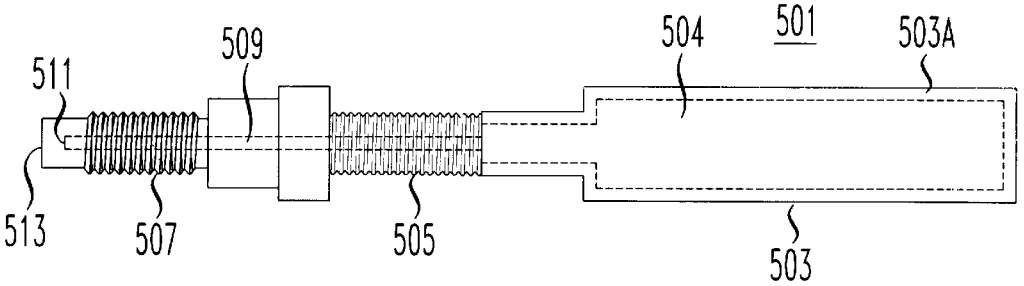
FIG. 5 is a rough sketch showing an exemplary lead holding element for use as part of a tool according to the invention.

FIG. 5 is a rough sketch showing an exemplary lead holding element 501 for use as part of a tool according to the invention. Lead holding element 501, in this exemplary embodiment is a conventional structure known to one of ordinary skill in the art. It includes a shaft 503 containing a lead storage cavity 504, a spring 505, a screw-in retaining portion 507, and a lead click passage 509 (shown in dotted lines) internal to spring 505 and screw-in retaining portion 507. The lead click passage 509 terminates in an expanding opening 511 comprising a plurality of sections that expand outwardly within opening 513 to allow lead to move therethrough.

Operationally, screw-in retaining portion 507 mates with a corresponding threaded section inside chamber 111 near head 100 and retains lead holding element 501 within shaft 109. Shaft 503 mates with cap 301, for example, at a region 503*a*, illustratively, in a matter which is the same as that of a conventional mechanical pencil. Thus, when a user presses on cap 301, the force on cap 301 is transferred to shaft 503, compresses spring 505, and causes the lead passage 509 to move relative to screw-in retaining portion 507, thus causing the sections of expanding opening 511 to open and allow the lead to "click" out one incremental distance toward or through opening 110. Additional presses on cap 301 will allow the user to select the distance the lead travels through and out of opening 110.

When the user is finished marking, and wants to return the lead to a position internal to head 100 so that the user can use screwdriver 105 for its primary purpose of driving a screw, the user simply maintains pressure on cap 301, causing sections of expanding opening 511 to move into and remain in the expanded position, while applying inward force to the lead, such as by pushing the lead in with the user's hand, or by pressing head 100 into a screw.

The invention is thus described with respect to a standard #2 Phillips-head screwdriver. This is purely by way of example and not of limitation. Also, the description above describes embodiments of the invention wherein the lead extends from the head end of a Philips-head screwdriver. This is also by way of example and not of limitation. For example, the writing element can extend from the handle portion of a screwdriver or from a different tool. Further, although lead is described as the writing material, other writing materials such as ink, chalk, paint, pastels, crayons, etc. may be employed.

The invention can also be realized by incorporating a writing element into any tool. The advantage of the screwdriver as an exemplary embodiment is that the screwdriver presents a longitudinal profile with an elongated shaft, and modification of a conventional screwdriver to incorporate a writing element according to the invention is fairly easy to comprehend and visualize once the overall concept of the invention is understood. Further, the #2 Phillips-head screwdriver is very common, and is an important element in a large percentage of handyman projects.

What is claimed is:

1. A tool, comprising:

a handle;

a head; and a shaft coupled to and intermediate the handle and the head, and said shaft containing a cavity, the cavity including a writing element, wherein the head includes a plurality of flanges adapted to drive a screw, and an opening in said head adapted to position a portion of the writing element in a position extended from a distal end of the head.

2. A tool as recited in claim 1, wherein the writing element comprises a pencil lead, the tool further comprising a lead extending element adapted to cause an extension of the writing element through the distal end.

3. A tool as recited in claim 2, wherein the lead extending element includes a user-manipulable button incorporated into the handle.

4. A tool as recited in claim 2, wherein the lead extending element includes a user-manipulable button incorporated into the shaft.

5. A tool as recited in claim 2, wherein the opening is centrally positioned between the flanges.

6. A tool as recited in claim 5, wherein the opening is in communication with a chamber internal to the shaft, and wherein the lead extending element includes a lead holding element positioned within the chamber.

7. A tool as recited in claim 6, wherein the lead extending element further includes a user-manipulable button coupled to the lead extending element to enable user control of lead extension.

8. A tool as recited in claim 7, wherein the user-manipulable button is incorporated into the handle.

9. A tool as recited in claim 7, wherein the user-manipulable button is incorporated into the shaft.

10. A method of making a mark, comprising the steps of:

a) manipulating a screwdriver to slideably extend a writing element from a screwdriver bit end thereof;

b) contacting a surface with the writing element to make a mark; and c) manipulating the screwdriver to slideably retract the writing element into the end, whereby the screwdriver is configured to drive a screw after step c).

11. A method as recited in claim 10, wherein the writing element is a pencil lead.

12. A method as recited in claim 10, wherein step a) comprises pressing a button on the screwdriver.

13. A method as recited in claim 12, wherein the button is on a shaft of the screwdriver.

14. A method as recited in claim 12, wherein the button is on an end of the screwdriver opposite the writing element.

15. A method as recited in claim 10, wherein the step c) comprises pushing a button on the screwdriver.

16. A method as recited in claim 15, wherein the step c) further comprises exerting an inward force onto an end of the writing element.

17. A method as recited in claim 16, wherein the pushing of the button and the exertion of the inward force occur concurrently.

* * * * *